US005199911A

United States Patent [19]

Dorwart, Jr. et al.

[11] Patent Number: 5,199,911

[45] Date of Patent: Apr. 6, 1993

[54] PRESS FIT SOLDER CUP

[75] Inventors: Charles E. Dorwart, Jr., Columbia; William T. Parker, Boiling Springs; Jeffrey L. Showers, Mechanicsburg, all of Pa.

[73] Assignee: AMP Incorporated, Harrisburg, Pa.

[21] Appl. No.: 852,850

[22] Filed: Mar. 16, 1992

Related U.S. Application Data

[63] Continuation of Ser. No. 677,012, Mar. 28, 1991, abandoned.

[51] Int. Cl.[5] ..... H01R 4/02

[52] U.S. Cl. ..... 439/874; 439/891

[58] Field of Search ..... 439/874–876, 439/891, 888

[56] References Cited

U.S. PATENT DOCUMENTS 3,170,752 2/1965 Van Horssen ..... 439/891

3,193,792 7/1965 Shea, Jr. ..... 439/932

3,675,189 7/1972 Smith ..... 439/891

4,812,129 3/1989 Rofer et al. ..... 439/891

*Primary Examiner*—David L. Pirlot

[57] ABSTRACT

A solder cup (24) adapted to be secured to the shank (44) of a contact (22) received in a connector (20) has a generally cylindrical body sized to receive the shank (44) of the contact (22) therein. The body has at least one retention feature (108) proximate a first end (92) that defines an effective diameter (132) within the bore (90) that is less than the cross section measurement of the shank (44) of a contact (22) to be received therein. Upon insertion of the shank (44) of a contact (22) into the bore (90) of the solder cup (24), an interference fit is achieved between the shank (44) and retention features (108) of the solder cup (24) to provide electrical engagement therebetween and to secure the solder cup (24) on the shank (44).

13 Claims, 7 Drawing Sheets

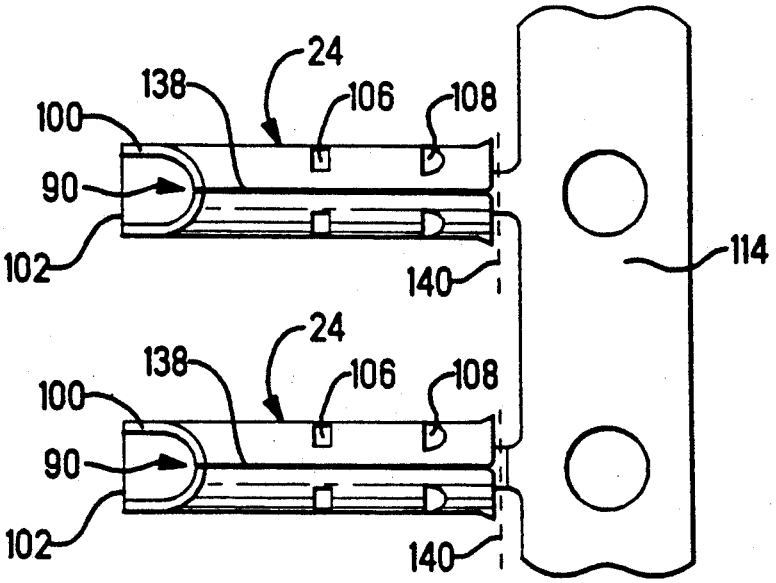
FIG. 4
FIG. 5
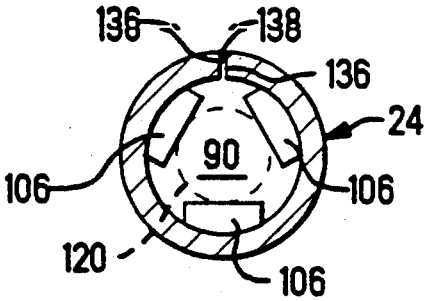
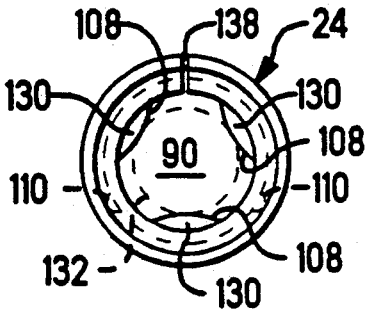
FIG. 6

PRESS FIT SOLDER CUP

This application is a continuation of application Ser. No. 07/677,012 filed Mar. 28, 1991, now abandoned.

BACKGROUND OF THE INVENTION

This invention relates to providing solder cups on the shank of contacts for electrical connectors and in particular to providing a stamped and formed solder cup that is press fitted onto the shank of contacts for an electrical connector to reliably secure the solder cup thereto and make electrical engagement therebetween.

A known prior art contact has a solder cup that is stamped and formed with the solder cup integral with the mating portion of the contact as disclosed in U.S. Pat. No. 4,717,354.

Other prior art contacts include a solder cup that is machined then crimped onto the shank of a contact. This prior art solder cup was not only expensive to manufacture, but had to be individually crimped onto the shank of a contact. This additional manufacturing step further increased the cost of utilizing a machined solder cup.

SUMMARY OF THE INVENTION

A solder cup adapted to be secured to the shank of a contact received in a connector has a generally cylindrical body sized to receive the shank of the contact therein. The body has at least one retention feature proximate a first end that defines an effective diameter within the shank that is less than the cross section measurement of a contact to be received therein. Upon insertion of the shank of a contact into the bore of the solder cup, an interference fit is achieved between the shank and the solder cup to provide electrical engagement therebetween and to secure the solder cup on the shank.

BRIEF DESCRIPTION OF THE DRAWING

FIG. 4 is a top view of two solder cups on a carrier strip;

FIG. 5 is a cross section through a solder cup showing the stop tabs;

FIG. 6 is a cross section through a solder cup showing the retention features;

DESCRIPTION OF THE PREFERRED EMBODIMENT

Figure 1:
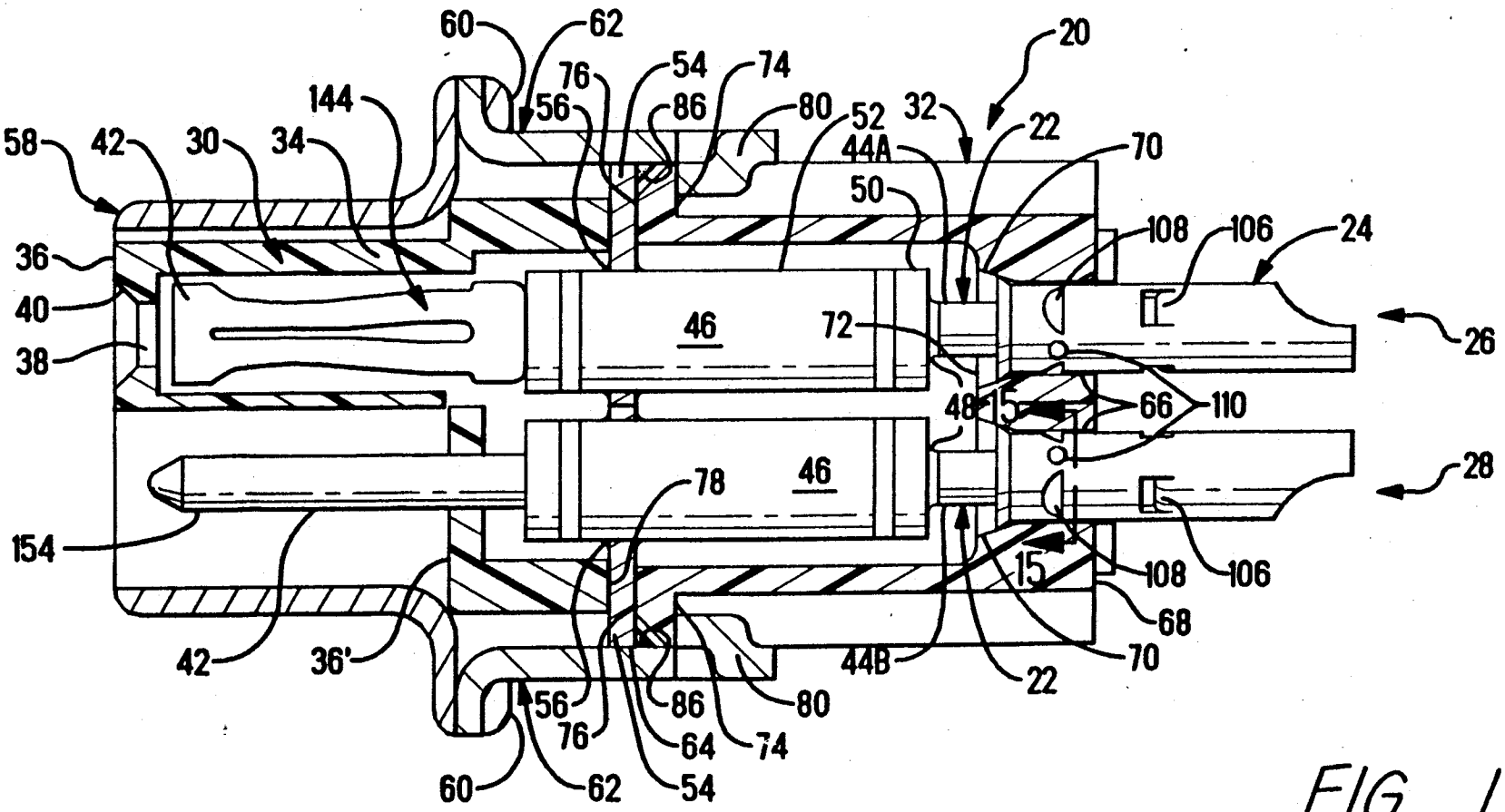
FIG. 1 is an offset side sectional view of a connector showing socket contacts in the upper row and pin contacts in the lower row, each having solder cups secured thereto in accordance with the present invention.

An electrical connector 20 having contacts 22 with press fit solder cups 24, in accordance with the present invention, secured thereto is shown in FIG. 1 in an offset cross sectional view. The illustrated connector is a subminiature D connector having one or more contacts 22 in the upper row of contacts 26 than in the lower row of contacts 28, and with the contacts 22 in the lower row 28 being spaced below and laterally between contacts in the upper row 26. The illustration in FIG. 1 shows that the present invention can be used with either pin or receptacle contacts, although likely all contacts in a given connector housing would be of only one type.

In the preferred embodiment, connector 20 is a shielded connector having a dielectric forward housing member 30 and a dielectric rear housing member 32 both molded of a suitable plastic material. Forward housing member 30 has a shroud portion 34 in the shape of a subminiature D extending forward to a mating face 36. Mating face 36 has a plurality of contact receiving apertures 38 extending therethrough which may have tapered lead-in surfaces 40 to receive terminals of a mating complementary connector (not shown). Contacts 22 have a forward mating portion 42, an intermediate shank 44 and a press fit solder cup 24 secured on shank 44.

Contacts 22 may have filters 46 passed axially over shank 44. Filters 46 are typically soldered to shank 44 at solder fillet 48 to secure filter 46 mechanically thereto as well as to complete an electrical path between a contact 22 and a first portion 50 of filter 46.

A second portion 52 of filter 46 is soldered to ground plate 54 at fillets 56. Fillets 56 mechanically secure filters 46 to ground plate 54 and provide an electrical path to ground. Filters 46 filter out high frequency, high voltage components in the signal being conducted over contacts 22 and pass these high frequency components to ground through ground plate 54.

Forward housing member 30 is surrounded by forward shield member 58 having a portion shaped to surround shroud portion 34. A rear shield member 62 is secured to forward shield member 58, such as by clinch tabs 60, and extends rearward therefrom.

Ground plate 54 engages the inner surface of rear shield member 62 at location 64 thereby being electrically commoned therewith, and through forward shield member 58 is connected to ground when a shielded complementary connector is mated with connector 20.

Rear housing member 32 has apertures 66 in a rear wall 68 for receiving solder cups 24. Apertures 66 are provided with tapered lead-in surfaces 70 on the inner surface 72 of rear wall 68. Rear housing member 32 has a peripheral flange 74 at its forward end. Flange 74 has a forward surface 76 that engages ground plate 54. The rear surface 78 of forward housing member 30 engages ground plate 54 when rear surface 78 of flange 72 latches behind resilient latch members 80. Latch members 80 are formed by bending a sheared portion of rear shield member 62 inwardly.

Figure 2:
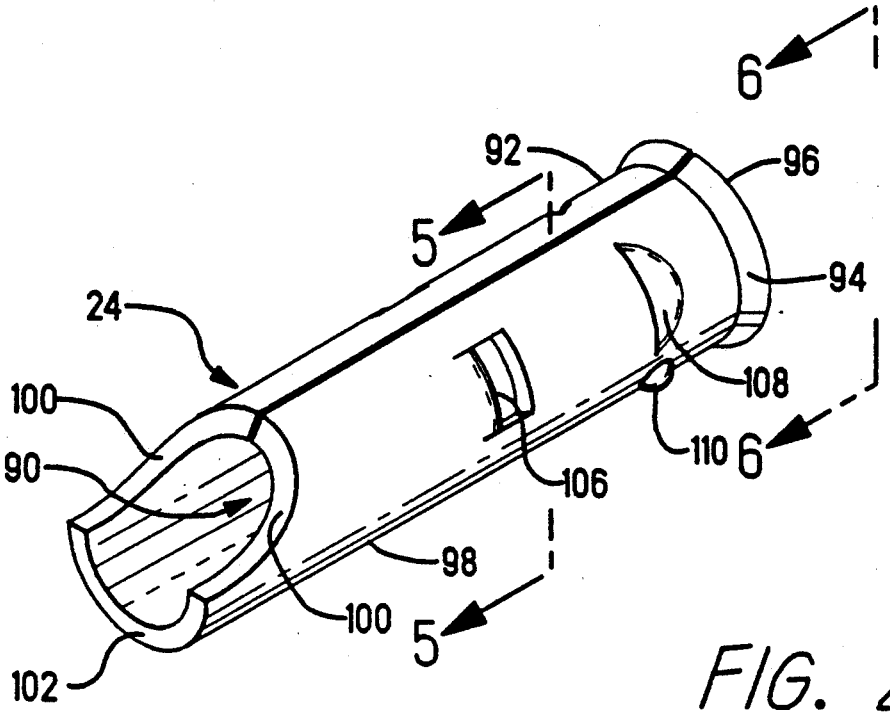
FIG. 2 is a perspective view of the press fit solder cup in accordance with the present invention.

FIG. 2 shows a stamped and formed press fit solder cup 24 in accordance with the present invention. Solder cup 24 is elongate, substantially cylindrical having an axial bore 90. A shank receiving first end 92 has a flared flange 94 adjacent to end surface 96 to assist in concentrically positioning shank 44 in bore 90 during assembly so as to avoid stubbing. A conductor receiving second end 98 has a scalloped upper region 100 extending along solder cup 24 from end surface 102 to facilitate receiving a conductor (not shown) for soldering in bore 90.

At a midpoint along solder cup 24 between end surfaces 96 and 102 are inwardly extending stop tabs 106 extending into bore 90. Between stop tabs 106 and end surface 96 are inwardly extending retention features 108, also extending into bore 90. Retention features 108 retain solder cup 24 on shank 44 when pressed axially thereon, and assure electrical continuity therebetween. Outwardly extending protrusions 110 provide an anti-rotation feature to prevent solder cup 24 from rotating in the assembled electrical connector.

Figure 3:
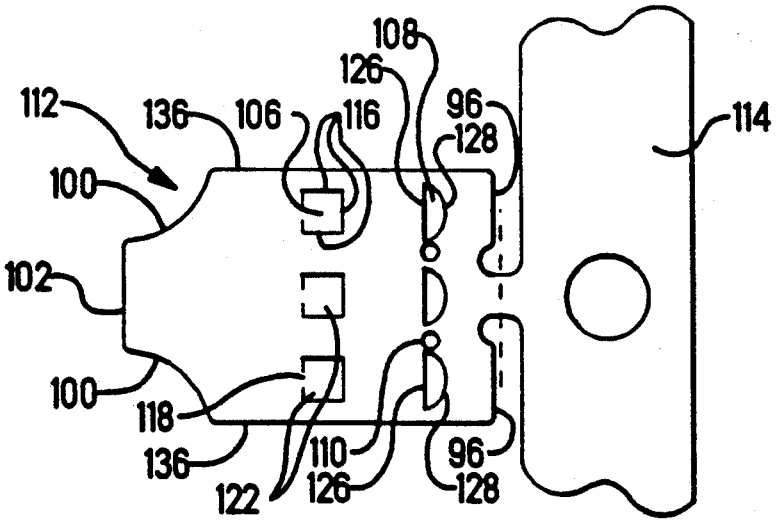
FIG. 3 is a blank of the solder cup during the stamping process.

FIG. 3 shows a stamped blank 112 integral with carrier strip 114 which, when completely formed will become solder cup 24. While solder cups 24 are typically stamped and formed from a phosphor bronze, the invention is not limited thereto.

Figure 9:
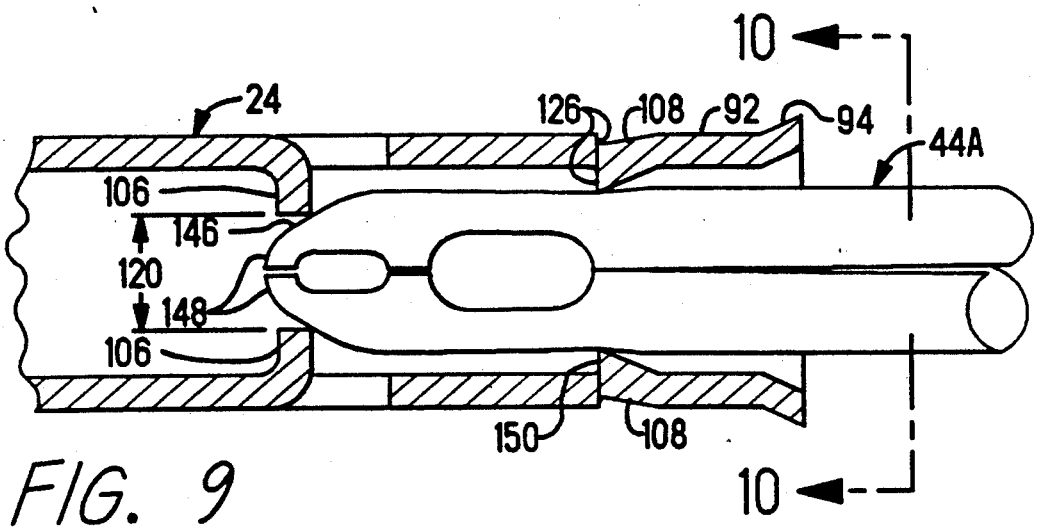
FIG. 9 is an enlarged partial cross section of the solder cup of FIG. 7 pressed onto the shank of a socket contact to the point where the shank engages the stop features to precisely position the solder cup on the shank.
Figure 13:
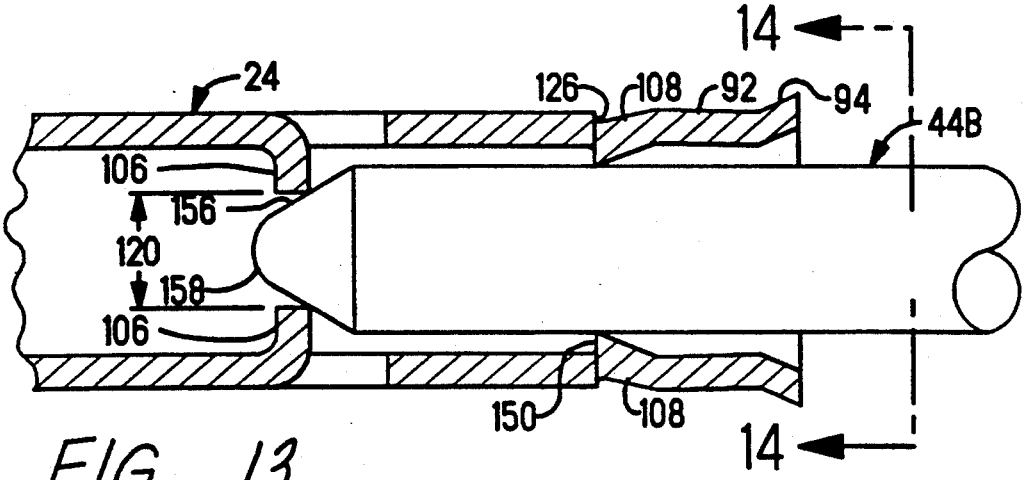
FIG. 13 is an enlarged partial cross section of the solder cup of FIG. 7 pressed onto the shank of a pin contact to the point where the shank engages the stop features to precisely position the solder cup on the shank.
Figure 16:
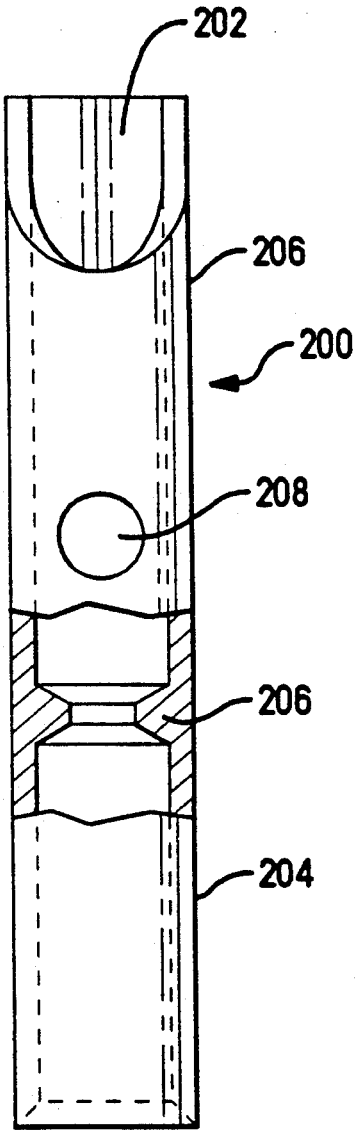
FIG. 16 PRIOR ART
FIG. 16 is a top view of a prior art solder cup.

Stop tabs 106 are defined by shear segments 116 which results in a sheared member 122 being sheared on three sides and secured to blank 112 along an edge. The free end of sheared member 122 is formed at bend 118 to be out of the plane of blank 112 in the direction, when blank 112 is completely formed, to extend into bore 90. Stop tabs 106 in press fit solder cup 24 extend into bore 90 to provide an effective stop diameter 120 that is less than the diameter of shank 44, as best seen in FIGS. 5, 9 and 13.

Retention features 108 are defined by a shear segment 126 transverse to what will be the axis of press fit solder cup 24. Features 108 are formed to be out of the plane of blank 112 in the direction, when blank 112 is completely formed, from shear segment 126 to arcuate segment 128 such that at least a portion of the sheared surface 130 extends into bore 90. Retention features 108 extend into bore 90 to provide an effective retention diameter 132 that is less than the diameter of shank 44, as best seen in FIGS. 6, 7–9 and 11–13.

Retention protrusions 110 are formed as dimples extending out the plane of blank 112 in the opposite direction to stop tabs 106 or retention features 108. In this manner, when press fit solder cup 24 is formed, the distal ends of protrusions 110, possibly along with other points on the exterior of press fit solder cup 24, provide an effective exterior diameter that is greater than the exterior diameter of solder cup 24 and greater than the diameter of the aperture 66 in which the solder cup is received.

Side edges 136 of blank 112 when solder cup 24 is formed, substantially touch each other defining seam 138.

Completely formed press fit solder cups 24 are shown in FIG. 4 on a carrier strip 114. Solder cups 24 may be stamped on or off the centerlines spacing of contacts 22 in connector 20, as spacing and materials requirements permit. During the assembly of connector 20, solder cups 24 are sheared from carrier strip 114, such as along dotted line 140.

FIGS. 7–10 show a sequence of partial sectional views as press fit solder cup 24 is pressed axially onto the shank **44*a* of a receptacle contact 144. A contact 22 in which the mating portion 42 is a receptacle, resulting in receptacle contact 144, is shown in the upper half of FIG. 1. Since the mating portion 42 of the receptacle contact 144 is stamped and formed, typically the shank 44*a* thereof is also stamped and formed. Thus, shank 44*a*** is a hollow cylindrical shape.

Figure 7:
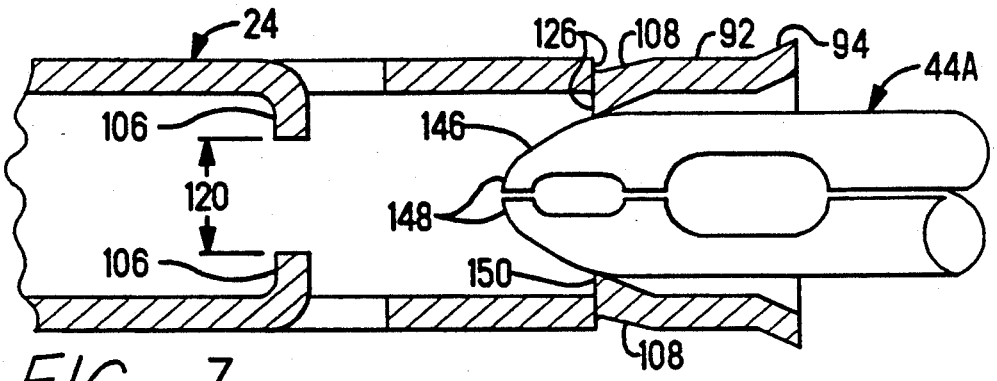
FIG. 7 is an enlarged partial cross section of a solder cup being pressed axially onto the shank of a socket contact at the point where the shank engages the retention features.
Figure 8:
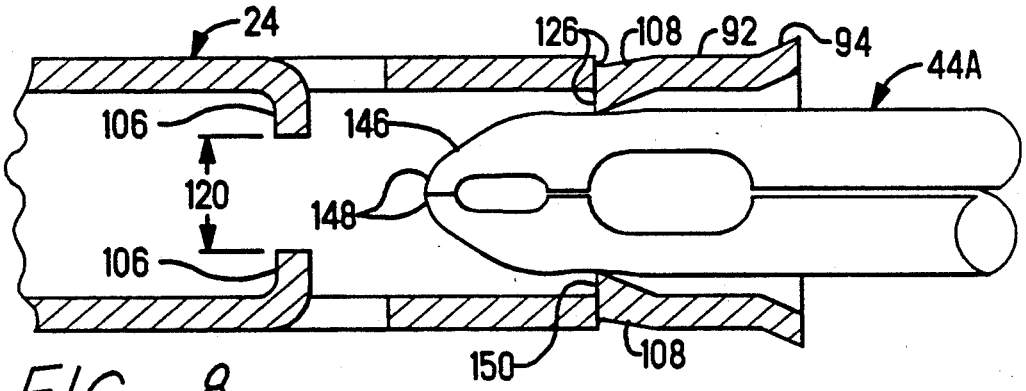
FIG. 8 is an enlarged partial cross section of a solder cup being pressed axially farther onto the shank of a socket contact then shown in FIG. 7.

To press solder cup 24 onto shank **44*a*, shank 44*a* is axially aligned with bore 90. Shank 44*a* and solder cup 24 are moved toward, relatively, each other. Shank 44*a* has a taper contour 146 at its leading end 148 to facilitate being received in flange 94 and bore 90 without stubbing. Since retention features 108 are formed inwardly to an effective diameter that is less than the diameter of shank 44*a*, features 108 will engage along the tapered contour 146 to resist further movement of shank 44*a* into bore 90, as shown in FIG. 7**.

Further movement of shank **44*a* into bore 90 requires increased force and causes retention features 108 to resiliently deflect outwardly as shank 44 passes farther into bore 90. Concomitantly, shank 44*a* may compress slightly or cause solder cup 24 to open at the seam 138** slightly or both.

Insertion of shank **44*a* continues until leading end 148 engages stop tabs 106 to properly position solder cup 24 on shank 44*a* to the proper location. Edges 150 of sheared surface 130 of retention features 108 are biased into engagement with the shank 44*a* to secure solder cup 24 on shank 44*a*. Retention features 108 are formed inwardly into bore 90, tapering from the circumference of solder cup 24 to a smaller effective diameter from proximate end surface 96 toward end surface 102 and stop tabs 106. The edge 150 frictionally engages shank 44*a* and may bite into the exterior surface of shank 44*a* to retain solder cup 24 on shank 44*a***.

Figure 10:
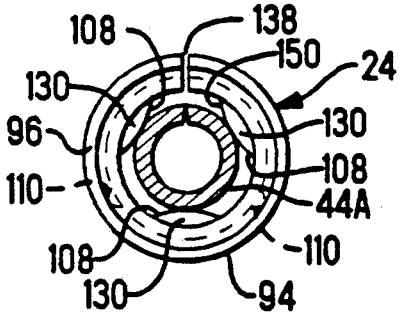
FIG. 10 is a cross section through the shank of a receptacle contact received in a solder cup, taken along the lines of 10—10 in FIG. 9.

While a single stop tab 106 and a single retention feature 108 will suffice, it has been found that three stop tabs and three retention features substantially equally spaced around the periphery have a centering effect to substantially center shank **44*a* in bore 90. FIG. 10 is a cross section view of a solder cup 24 on the shank 44*a* of a receptacle contact showing how shank 44*a* is substantially centered in bore 90 with seam 138 opened slightly and edges 150 engaging shank 44*a* to retain solder cup 24 on shank 44*a* and provide electrical engagement therewith. Furthermore, depending on the shape that may be given to retention features, since the retention feature used in the preferred embodiment provides a limited length along edge 150 that engages shank 44*a* multiple retention features enhance the retention of solder cup 24 on shank 44**.

Figure 11:
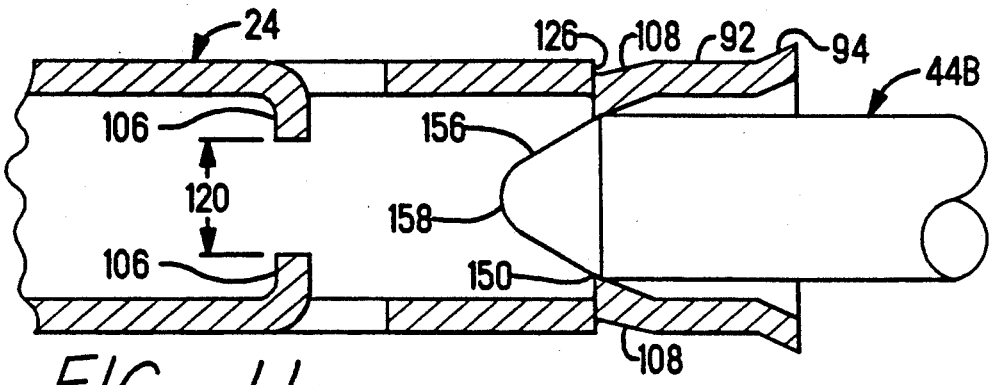
FIG. 11 is an enlarged partial cross section of a solder cup being pressed axially onto the shank of a pin contact at the point where the shank engages the retention features.
Figure 12:
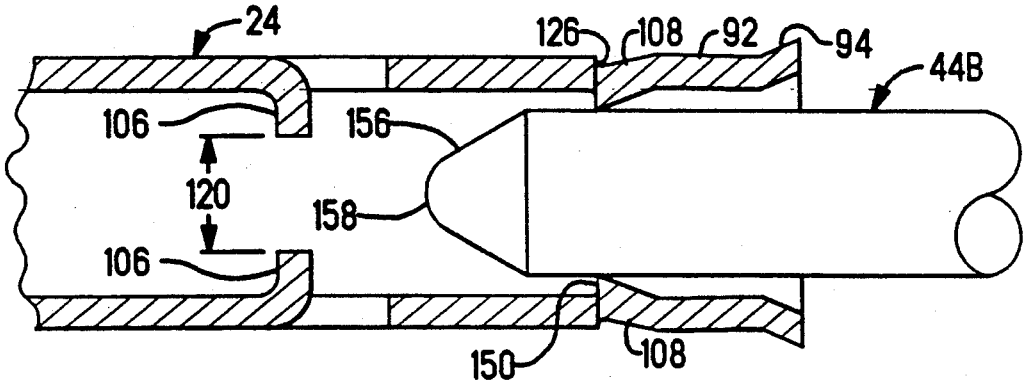
FIG. 12 is an enlarged partial cross section of a solder cup being pressed axially farther onto the shank of a pin contact then shown in FIG. 7.

FIGS. 11–13 show a sequence of partial sectional views as press fit solder cup 24 is pressed axially onto the shank 44b of a pin contact 154. A contact 22 in which the mating portion 42 is a pin, resulting in pin contact 154 is shown in the lower half of FIG. 1. Pin contacts may be stamped but are more economically manufactured from drawn wire. Regardless of how they are manufactured, the shank 44b thereof is a solid member and thus functions slightly differently than the hollow stamped and formed shank 44a of receptacle contact 144. Shank 44b is axially aligned with bore 90. Shank 44b and solder cup 24 are moved toward each other, relatively. Shank 44b has a tapered contour 156 at its leading end 158 to facilitate being received in flange 94 and bore 90 without stubbing. Shank 44b has substantially the same outer diameter as does shank 44a. Since retention features 108 are formed inwardly to an effective diameter that is less than the diameter of 44b, features 108 will engage along tapered contour 156 to resist further movement of shank 44b into bore 90, as shown in FIG. 11.

Further movement of shank 44b into bore 90 requires increased force and causes retention features 108 to resiliently deflect outwardly as shank 44b passes. Simultaneously, solder cup 24 may open slightly at seam 138.

Insertion of shank 44b continues until leading end 158 engages at least one stop tab 106 to properly position solder cup 24 on shank 44b at the proper location. Distal edges 150 of retention features 108 are biased into engagement with shank 44b to secure solder cup 24 on shank 44b. Since retention features 108 are formed inwardly into bore 90, tapering from the circumference of solder cup 24 to a smaller effective diameter than the diameter 44b, edges 150 frictionally engage shank 44b and may bite into the exterior surface of shank 44b to retain solder cup 24 on shank 44b.

Figure 14:
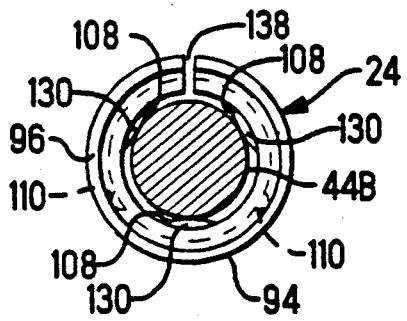
FIG. 14 is a cross section through the shank of a pin contact received in a solder cup, taken along the lines 14—14 in FIG. 13.

FIG. 14 is a cross section showing a solder cup on a shank 44b of a pin contact 154 wherein the shank is substantially centered in bore 90 with seam 138 opened slightly and edges 150 frictionally engaging shank 44b to retain solder cup 24 on shank 44b.

Connector 20 is assembled by positioning a filter 46 on the shank 44 of each contact 22 and in respective apertures of ground plate 54 and soldered. This subassembly is inserted into the open back of forward housing member 30. Ground plate 54 is soldered to rear shield member 62 at solder fillets 86. Shield member 58 is positioned over housing member 30 and secured to shield member 60. At this stage of assembly, a number of solder cups 24 required for one of rows 26 or 28 of contacts 22 are grasped while still on carrier strip 114 thence sheared from carrier strip 114. This "row" of solder cups 24 are aligned with then simultaneously pressed onto the respective shanks 44, as described above, of the selected row of contacts already in the housing. A number of solder cups required for the other row of contacts is subsequently grasped while still on carrier strip 114 thence sheared from carrier strip 114. This "row" of solder cups are rotated 180°, aligned with then simultaneously pressed onto the respective shank 44 of the contacts in the selected row of contacts already in housing member 30.

Rear housing member 32 is then pressed over solder cups 24 with each solder cup end surface 102 first being received in a respective aperture. The peripheral flange of rear housing member 32 latches under latch members 80 to secure rear housing member 32 thereto.

Each solder cup 24 passes into and partially through a respective aperture 66, with at least portion of second end 98 extending beyond rear face 68 of rear housing member 32 as shown in FIG. 1. Flange 94 is received in tapered lead-in 70, prevents solder cup 24 from passing completely through apertures 66 and may engage the tapered lead-in surface to provide a centering effect. In this manner, conductors can be easily soldered thereon. When the conductor is soldered in a solder cup 24 the retention of solder cup 24 on shank 44 may be enhanced by the solder joint.

Figure 15:
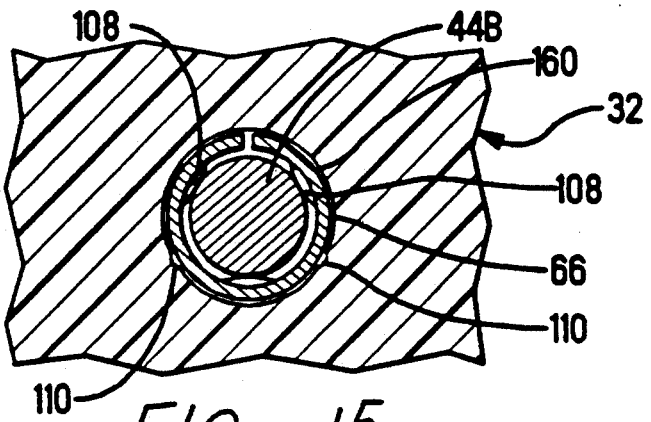
FIG. 15 is a cross section through the rear housing member, taken along the lines 15—15 of FIG. 1.

Protrusion 110 typically pass beyond taper lead-in surfaces to provide an interference fit in the wall 160 forming aperture 66, as shown in FIG. 15. This interference fit prevents solder cup 24 from rotating on shank 44 within aperture 66.

It has been found that a single solder cup can be used for the shank of both contacts having a hollow structure and a solid cross section. The solder cup was stamped and formed from 0.0085 inch (0.216 mm.) thick phosphor bronze to have a nominal inside diameter of 0.0575 inches (1.461 mm.). The nominal outside diameter of the contact shank was 0.040 inches (1.016 mm.). The retention features were formed inwardly to an effective diameter of 0.036 inches (0.914 mm.). In a preferred embodiment protrusions 110 extended 0.003 inches (0.076 mm.) beyond the surrounding exterior surface of solder cup 24. This increased the effective diameter of the most distant points, such that when combined with the expansion of the solder cup upon receiving a shank therein, to assure an interference fit in aperture 66 having a nominal hole diameter of 0.070 inches (1.78 mm).

FIG. 6 shows a prior art solder cup 200 securable to a contact. Typically the prior art solder cups 200 that were manufactured separately from the contacts were machined from brass or phosphor bronze material. Solder cups 200 had a substantially cylindrical exterior and substantially coaxial bore 202. A contact shank was received in the bore 202 of a first end 204 as far as restriction 206 would permit. Each solder cup 200 was crimped onto a contact to secure the solder cup thereto.

A second end of the solder cup 200, when the contact was in a connector, extended rearward of the connector housing to receive and be soldered to a conductor. Aperture 208 permitted observing whether the conductor was sufficiently inserted into bore 202 as well as the solder joint.

We claim:

1. A solder cup adapted to be secured to the shank of a contact, said contact adapted to be received in a connector housing, the solder cup comprising:

a generally hollow body defining a bore sized to receive the shank of a contact therein from a first end, said body having at least one inwardly directed resilient retention feature proximate said first end, said at least one inwardly directed retention feature extending into said bore to define an effective diameter within said bore that is less than a cross section measurement of a contact adapted to be received in the bore, said solder cup adapted to receive and be soldered to a conductor proximate a second end and at least one inwardly directed stop member extending into said bore, said stop member positioned along said body to define the insertion depth of the shank within the bore, whereby upon insertion of the shank of a contact into the bore of the solder cup the shank is retained therein by engagement between said at least one resilient retention feature and said shank.

2. A solder cup as recited in claim 1, wherein said at least one inwardly directed stop member comprises three equidistantly spaced stop members.

3. A solder cup adapted to be secured to the shank of a contact, said contact adapted to be received in a connector housing, the solder cup comprising:

a generally hollow body defining a bore sized to receive the shank of a contact therein from a first end, said body having at least one inwardly directed resilient retention feature proximate said first end, said at least one inwardly directed retention feature extending into said bore to define an effective diameter within said bore that is less than a cross section measurement of a contact adapted to be received in the bore, said solder cup adapted to receive and be soldered to a conductor proximate a second end and at least one outwardly directed anti-rotation protrusion, said at least one protrusion extending beyond the outer profile of the body in the region of the protrusion, whereby upon insertion of the shank of a contact into the bore of the solder cup the shank is retained therein by engagement between said at least one resilient retention feature and said shank.

4. An electrical connector, comprising:

a housing;

at least one contact secured in said housing, said contact having a mating section and a substantially cylindrical shank extending therefrom to a distal end;

a press fit solder cup secured to said shank at said distal end, said solder cup having a generally hollow body defining a bore sized to receive the shank;

said body having at least one inwardly directed resilient retention feature, said at least one inwardly directed retention feature extending into said bore and engaging said shank to secure the solder cup on said shank;

said housing has a rear wall with at least one aperture therein to receive respective ones of the at least one contact; said at least one aperture defining an aperture wall; and the at least one aperture further comprises a tapered lead-in proximate an inner surface of said rear wall.

5. An electrical connector as recited in claim 4 wherein a first end of the solder cup received on the shank is flared forming a flange, said flange being larger than said at least one aperture in size, said flange received in said tapered lead-in, whereby the flange prevents the solder cup from passing through said at least one aperture.

6. An electrical connector as recited in claim 4 wherein the solder cup further comprises at least one outwardly directed anti-rotation protrusion, said protrusion engaging the aperture wall to prevent rotation of the solder cup in said at least one aperture.

7. A solder cup adapted to be secured to the shank of a contact, said contact adapted to be received in a connector housing, the solder cup comprising:

a generally hollow body defining a bore sized to receive the shank of a contact therein from a first end, the first end being flared to facilitate insertion of the shank into the bore, said body having at least one inwardly directed resilient retention feature proximate said first end, said at least one inwardly directed retention feature extending into said bore to define an effective diameter within said bore that is less than a cross section measurement of the shank a contact adapted to be received in the bore, said solder cup adapted to receive and be soldered to a conductor proximate a second end, whereby upon insertion of the shank of a contact into the bore of the solder cup the shank is retained therein by engagement between said at least on resilient retention feature and said shank.

8. A solder cup as recited in claim 7, wherein said at least one inwardly directed retention feature comprises three equiangularly spaced retention features.

9. A solder cup as recited in claim 7, wherein said body further comprises at least one outwardly directed anti-rotation protrusion, said at least one protrusion extending beyond the outer profile of the body if the region of the protrusion.

10. An electrical contact adapted to be received in an electrical connector, said contact comprising:

a mating section and a substantially cylindrical shank extending therefrom to a distal end;

a cylindrical press fit solder cup secured to said shank at said distal end, said solder cup having a generally hollow body defining a bore sized to receive the shank in a first end thereof;

said body having at least one inwardly directed resilient retention feature in said first end, said at least one inwardly directed retention feature extending into said bore and engaging the shank to secure the solder cup on the shank;

a second end of the cylindrical solder cup extending beyond the distal end of the shank, said second end adapted to receive in said bore thereof a conductor for soldering therein; and at least one inwardly directed stop member extending into said bore, said stop member positioned along said body to define the insertion depth of the shank within the bore.

11. An electrical contact adapted to be received in an electrical connector, said contact comprising:

a mating section and a shank extending therefrom to a distal end;

a press fit solder cup secured to said shank at said distal end, said solder cup having a generally hollow body defining a bore sized to receive the shank, said body having at least one inwardly directed resilient retention feature, said at least one inwardly directed retention feature extending into said bore and engaging the shank to secure the solder cup on the shank, said solder cup having at least one inwardly directed stop member extending into said bore, said stop member positioned along said body to define the insertion depth of the shank with the bore.

12. A solder cup adapted to be secured to the shank of a contact, said contact adapted to be received in a connector housing, the solder cup comprising:

a generally hollow body defining a bore sized to receive the shank of a contact therein from a first end, said body having three equiangularly spaced inwardly directed resilient retention features proximate said first end, said retention features extending into said bore to define an effective diameter within said bore that is less than a cross section measurement of the shank a contact adapted to be received in the bore, said solder cup adapted to be received in the bore, said solder cup adapted to receive and be soldered to a conductor proximate a second end, whereby upon insertion of the shank of a contact into the bore of the solder cup the shank is retained therein by engagement between said at least one resilient retention feature and said shank.

13. A solder cup as recited in claim 12 further comprising a seam along the length of said body, said seam adapted to open slightly when the solder cup is received on the shank of a contact.

* * * * *